US008205771B2

(12) United States Patent
Compton

(10) Patent No.: US 8,205,771 B2
(45) Date of Patent: Jun. 26, 2012

(54) DISPENSER AND SELF-PIERCING LID FOR DISPENSING PUMPABLE PRODUCTS

(75) Inventor: Stephen F. Compton, Spartanburg, SC (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 591 days.

(21) Appl. No.: 12/228,334

(22) Filed: Aug. 12, 2008

(65) Prior Publication Data

US 2010/0038380 A1 Feb. 18, 2010

(51) Int. Cl.
*B65D 35/56* (2006.01)

(52) U.S. Cl. ..... 222/105; 222/81

(58) Field of Classification Search ..... 222/105, 222/100, 277, 278, 83, 82, 81; 383/200–202; 220/277, 278

See application file for complete search history.

(56) References Cited

U.S. PATENT DOCUMENTS 3,474,933 A 10/1969 Malpas
4,324,333 A * 4/1982 Porter ..... 206/526
4,401,239 A 8/1983 Thomassen
4,521,437 A 6/1985 Storms
4,562,940 A * 1/1986 Asphar ..... 222/88
4,589,247 A 5/1986 Tsuruta et al.
4,603,581 A 8/1986 Yamanoue et al.
4,656,818 A 4/1987 Shimoyama et al.
4,700,841 A * 10/1987 Padgett et al. ..... 206/499
4,726,471 A * 2/1988 Whately et al. ..... 206/554
4,746,562 A 5/1988 Fant
4,768,411 A 9/1988 Su
4,776,488 A 10/1988 Guzan
4,795,062 A 1/1989 Bedwell et al.
4,808,010 A 2/1989 Vogan
4,946,040 A * 8/1990 Ipenburg ..... 383/202
5,127,550 A 7/1992 Knorr
5,328,055 A * 7/1994 Battle ..... 222/83.5
5,421,485 A 6/1995 Furuta et al.
5,467,581 A 11/1995 Everette
5,573,047 A 11/1996 Akin
5,626,255 A * 5/1997 Myers ..... 220/705
5,730,327 A * 3/1998 Stern ..... 222/82
6,294,761 B1 * 9/2001 Diederich et al. ..... 219/386
6,554,164 B1 * 4/2003 Jones ..... 222/105
6,651,845 B1 11/2003 Schroeder
6,860,407 B2 3/2005 Gosselin
7,188,749 B2 3/2007 Miller et al.
2004/0139697 A1 * 7/2004 Reddy et al. ..... 53/412
2006/0111224 A1 5/2006 Caudle
2007/0145071 A1 6/2007 Miller et al.
2007/0205216 A1 9/2007 Smith
2008/0023359 A1 1/2008 Churvis et al.
2008/0029540 A1 2/2008 Johnson
2008/0041882 A1 2/2008 Lips

* cited by examiner

*Primary Examiner* — Lien T Ngo
(74) *Attorney, Agent, or Firm* — Ashley D. Wilson

(57) ABSTRACT

The presently disclosed subject matter comprises a pouch to house a pumpable product, a pouch fitment sealed within or outside the pouch, and a rigid dispenser for containing the pouch and fitment. In some embodiments, the system can further comprise a pump operatively connected to the rigid dispenser to dispense the pouch contents. The rigid dispenser is advantageously configured with a raised segment to support, center, and elevate the fitment sealed within said pouch.

31 Claims, 9 Drawing Sheets

DISPENSER AND SELF-PIERCING LID FOR DISPENSING PUMPABLE PRODUCTS

TECHNICAL FIELD

The presently disclosed subject matter relates generally to a system and method for dispensing a pumpable product, comprising a rigid dispenser, a pouch, and a pumping device.

BACKGROUND

Vertical form/fill/seal ("VFFS") packaging systems have proven to be useful in packaging a wide variety of food and non-food pumpable products. One example of such a system is the Onpack™ packaging system marketed by Cryovac/Sealed Air Corporation (Saddle Brook, N.J., United States of America). The VFFS process is known to those of ordinary skill in the art, and is described in U.S. Pat. No. 4,589,247 to Tsuruta et al.; U.S. Pat. No. 4,656,818 to Shimovama et al.; U.S. Pat. No. 4,768,411 to Su; and U.S. Pat. No. 4,808,010 to Vogan, inter alia, all incorporated herein in their entireties by reference thereto.

In such a process, lay-flat thermoplastic film is first advanced over a forming device to form a tube. Next, a longitudinal (vertical) fin or lap seal is made, and a bottom end seal is formed by transversely sealing across the tube with heated seal bars. A pumpable product is introduced through a central, vertical fill tube to the formed tubular film. The pouch is then completed by sealing the upper end of the tubular segment, and severing the pouch from the tubular film above it. The process can be a two-stage process wherein the creation of a transverse heat seal occurs at one stage of the process, and downstream of the first stage, a separate pair of cooling/clamping means contact the newly-formed transverse heat seal to cool and thus strengthen the seal. In some VFFS processes, an upper transverse seal of a first pouch and the lower transverse seal of a following pouch are made. The pouches are then cut and thereby separated between two portions of the transverse seals without the need for a separate step to clamp, cool, clamp, cool, and cut the seals. A commercial example of an apparatus embodying this more simplified process is the Onpack™ 2050A VFFS packaging machine marketed by Cryovac/Sealed Air Corporation.

U.S. Pat. No. 4,603,793 to Stern, incorporated herein in its entirety by reference thereto, discloses a coupling means mounted on the inside wall of a pouch. The coupling means (or fitment) offers several advantages in packaging products, such as the capability of connecting the fitment to a pumping device. The coupling means further permits the contents of the package to be dispensed in a controllable manner. Packaging systems combining the Onpack™ system with the fitment technology of Stern have proven effective in providing a pouch-making system wherein a pouch containing a product includes an internal fitment. The fitment is typically near one end of the pouch to ensure that the contents of the pouch are directed, e.g., by gravity, toward and pumped from and through the fitment by a suitable pump dispensing system. One example of a method and apparatus for installing fitments of the type disclosed by Stern is disclosed in U.S. Pat. No. 5,467,581 to Everette, incorporated herein in its entirety by reference thereto. An alternative system is disclosed in U.S. Patent Publication No. 2006/0111224A1 to Caudle, incorporated herein in its entirety by reference thereto.

In many industries, including quick service restaurants and the like, pumpable products are typically dispensed from relatively small stainless steel or plastic product wells. Such wells are typically manually filled by store employees, and are usually in one of two arrangements. In the first arrangement, the well is manually filled with a pumpable product, such as flavored toppings, sauces, liquid condiments of various viscosities (ketchup, mustard, mayonnaise, etc.), and the like. The employee spoons out a more or less appropriate amount of the product as needed. The arrangement can sometimes be accessed directly by the customer.

An alternative arrangement includes a cover, typically made of stainless steel, having a portion control pump fitted therein. After manual filling of a well, a cover carrying or accommodating a pump is dropped onto the top of the well. The pump is conventional in nature for this application, and those skilled in the art will be familiar with the various makes and models of pumps and their operation, such that further details are not provided herein. After filling the product well and installing the cover and pump, the pump can be activated as needed, e.g., manually, to dispense a controlled portion of the product from the well, through the pump, and onto a plate, food product, container, etc.

However, the current systems for dispensing pumpable products suffer from several problems. First, product wells tend to be small in volume, typically about 0.5 gallons, such that they require frequent refilling in high-use environments. Second, refilling is accomplished by pouring the product from rigid or semi-rigid containers, such as cans or jugs. When an employee, particularly an inexperienced one, attempts a refill, the process can be untidy, as product misses the well, overflows past the top of the well, etc.

A third problem associated with conventional systems is the need to periodically clean the well. When very viscous and/or high sugar content products are being used, properly cleaning the well can be labor intensive, time consuming, and difficult. In addition, product freshness becomes an issue when the product is disposed in the well for an extended period of time. Product freshness issues can be aggravated by conditions where the product is dispensed at relatively high temperatures, wherein evaporation through long exposure to high temperatures significantly and adversely affects the quality of the product.

SUMMARY

In some embodiments, the presently disclosed subject matter comprises a dispensing system for dispensing a pumpable product. The dispensing system comprises a rigid dispenser and a pouch disposed within the bottom portion of the dispenser. The rigid dispenser comprises a base having four upright walls and a bottom portion, wherein the bottom portion comprises an approximately centrally located support means. The support means functions to support, center, and elevate a pouch fitment sealed with the pouch. The rigid dispenser also comprises a lid for positioning onto the base, wherein the lid comprises a piercing fitment mounted to the inside of the lid. The pouch disposed within the bottom portion of said dispenser comprises a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal. The pouch also comprises a pouch fitment disposed on an inner or outer surface of the first wall of the pouch, wherein the pouch is positioned in the base fitment-side facing up. The pouch contains the pumpable product.

In some embodiments, the presently disclosed subject matter is directed to a method for dispensing a pumpable product. The method comprises providing a rigid dispenser comprising a base and a lid for seating onto the base. The base has four upright walls and a bottom portion, wherein the bottom portion comprises an approximately centrally located support means. The lid comprises a piercing fitment mounted to the inside of the lid. A pouch is also provided, wherein the pouch comprises a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal. The pouch also comprises a pouch fitment disposed on an inner or outer surface of the first wall of the pouch, wherein the pouch is positioned in the base with the fitment-side facing up. The pouch is filled with pumpable product. The pouch is then positioned inside the bottom portion of the dispenser such that said pouch fitment is raised, centered, properly located, and supported by the support means in the base. The lid is then positioned onto the base such that the pouch fitment is pierced by the piercing fitment. A dispensing mechanism is connected to the piercing fitment and then activated to dispense the pumpable product from the pouch.

In some embodiments, the presently disclosed subject matter is directed to a method of making a dispensing system. The method comprises providing a rigid dispenser comprising a base having four upright walls and a bottom portion, wherein the bottom portion comprises an approximately centrally located support means. The dispenser also comprises a lid for seating onto the base, wherein the lid comprises a piercing fitment mounted to the inside of the lid. A pouch comprising a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal is also provided. The pouch also comprises a pouch fitment disposed on an inner or outer surface of the first wall of the pouch, wherein the pouch is positioned in the base with the pouch fitment-side facing up. The pouch is then filled with a pumpable product. The pouch is next positioned inside the base of the dispenser such that the pouch fitment is raised, centered, and supported by the support means in the base. A dispensing mechanism is then connected to the piercing fitment. The dispensing mechanism is activated to dispense the pumpable product from the pouch.

DETAILED DESCRIPTION

I. General Considerations

Figure 1:
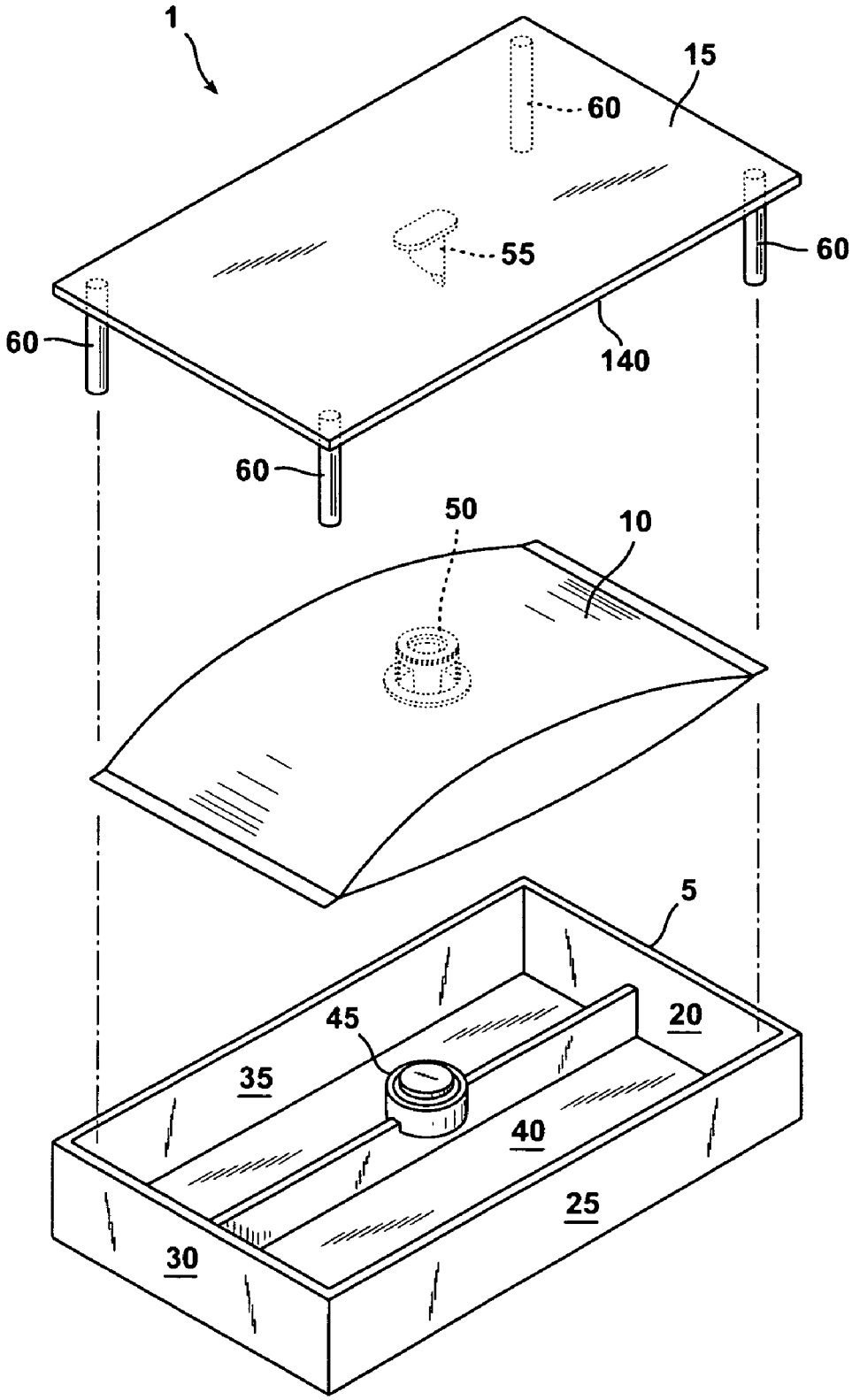
FIGS. 1 and 2 are perspective views of systems for dispensing a pumpable product.

The presently disclosed subject matter is directed to an improved dispensing system that utilizes a pouch configured and adapted for sealing with a fitment that can be substantially centrally (geometrically) located on a surface of the pouch. In some embodiments, the fitment is located on an inside surface, outside surface, or both the inside and outside surfaces of the pouch, as set forth in U.S. Pat. No. 5,467,581 to Everette and U.S. Pat. No. 6,860,407 to Gosselin, incorporated herein in their entireties by reference thereto.

The pouch can be inserted into a rigid dispensing system comprising a base and a lid. The base can have an approximately centrally located raised segment that can be used to support, center, and elevate the pouch fitment. The lid portion comprises a piercing fitment mounted to the inside of the lid such that when the lid is positioned onto the base portion of the dispenser, the piercing fitment pierces the pouch fitment. A dispensing mechanism can then be connected to the piercing fitment to dispense pumpable product from the pouch to an external container or directly onto an item (such as, but not limited to, a food item).

The presently disclosed subject matter thus provides an improved dispensing system for packaging pumpable materials, such as liquids and the like.

II. Definitions

While the following terms are believed to be understood by one of ordinary skill in the art, the following definitions are set forth to facilitate explanation of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, device, and materials are now described.

Following long-standing patent law convention, the terms "a", "an", and "the" can refer to "one or more" when used in the subject specification, including the claims. Thus, for example, reference to "a pouch" (e.g., "a dispensing pouch") includes a plurality of such pouches, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, or percentage can encompass variations of, in some embodiments ±20%, in some embodiments ±10%, in some embodiments ±5%, in some embodiments ±1%, in some embodiments ±0.5%, and in some embodiments to ±0.1%, from the specified amount, as such variations are appropriate in the disclosed system and methods.

As used herein, the term "abuse layer" refers to an outer film layer and/or an inner film layer, so long as the film layer serves to resist abrasion, puncture, and other potential causes of reduction of package integrity, as well as potential causes of reduction of package appearance quality. The abuse layer can comprise any polymer, so long as the polymer contributes to achieving an integrity goal and/or an appearance goal. In some embodiments, the abuse layer can comprise polyamide, ethylene/propylene copolymer (such as, but not limited to, nylon 6, nylon 6/6, amorphous nylon), and/or combinations thereof. In some embodiments, the abuse layer can comprise polymer having a modulus of at least $10^7$ Pascals at room temperature.

As used herein, the term "barrier" and the phrase "barrier layer", as applied to films and/or film layers, refers to the ability of a film or film layer to serve as a barrier to gases and/or odors. Examples of polymeric materials with low oxygen transmission rates useful in such a layer can include: ethylene/vinyl alcohol copolymer (EVOH), polyvinylidene dichloride (PVDC), vinylidene chloride copolymer such as vinylidene chloride/methyl acrylate copolymer, vinylidene chloride/vinyl chloride copolymer, polyamide, polyester, polyacrylonitrile (available as Barex™ resin), or blends thereof. Oxygen barrier materials can further comprise high aspect ratio fillers that create a tortuous path for permeation (e.g., nanocomposites). Oxygen barrier properties can be further enhanced by the incorporation of an oxygen scavenger, such as an organic oxygen scavenger (e.g., comprising poly (ethylene/methyl acrylate/cyclohexene methyl acrylate, with or without a transition metal catalyst). In some embodiments, metal foil, metallized substrates (e.g., metallized polyethylene terephthalate (PET), metallized polyamide, or metallized polypropylene), or coatings comprising SiOx or AlOx compounds can be used to provide low oxygen transmission to the disclosed package.

The term "base" as used herein refers to the foundation or bottom portion of a dispensing unit or carton.

As used herein, the term "bottom" or "bottom portion" refers to the portion of the disclosed dispenser that would rest on a solid surface, such as a countertop.

As used herein, the term "bulk layer" refers to any layer of a film that is present for the purpose of increasing the abuse-resistance, toughness, modulus, etc., of a film. Bulk layers can comprise polymers that are inexpensive relative to other polymers in the film that provide some specific purpose unrelated to abuse-resistance, modulus, etc. In some embodiments, bulk layers can comprise polyolefin; in some embodiments, at least one member selected from the group comprising ethylene/alpha-olefin copolymer, ethylene/alpha-olefin copolymer plastomer, low density polyethylene, and linear low density polyethylene.

As used herein, the term "dispenser" refers to a body defining a reservoir containing a quantity of fluid or pumpable material typically sufficient for a number of repeated applications by a user.

As used herein, the term "film" includes, but is not limited to, a laminate, sheet, web, coating, and/or the like, that can be used to package a product. The film can be a rigid, semi-rigid, or flexible product, and can be adhered to a non-polymeric or non-thermoplastic substrate such as paper or metal to form a rigid, semi-rigid, or flexible product or composite. The FS laminates, such as FS 7055, sold by Sealed Air Corporation through the Cryovac Division, are examples of packaging materials suitable for the VFFS process. Such laminates are described in U.S. Pat. No. 4,746,562 to Fant, incorporated herein in its entirety by reference thereto. An alternative laminate that can be used in accordance with the presently disclosed subject matter is SCLAIR™ sealant film, an ethylene/alpha-olefin copolymer marketed by DuPont Canada, and described in U.S. Pat. No. 4,521,437 to Storms, incorporated herein in its entirety by reference thereto. Any of a wide variety of other films and laminates useful for dry or wet fluid packaging are available and can be used with the presently disclosed dispensing system.

As used herein, the phrase "inside layer" refers to the outer layer of a multilayer film packaging a product, which is closest to the product, relative to the other layers of the multilayer film.

As used herein, the term "lid" includes any type of container closure cap, cover, stopper, plug, crown, top, plate or the like that functions as a closure that at least partially seals or closes a dispenser.

As used herein, the term "oriented" refers to a polymer-containing material that has been stretched at an elevated temperature (the orientation temperature), followed by being "set" in the stretched configuration by cooling the material while substantially retaining the stretched dimensions. Upon subsequently heating unrestrained, unannealed, oriented polymer-containing material to its orientation temperature, heat shrinkage is produced almost to the original unstretched, i.e., pre-oriented dimensions. More particularly, the term "oriented", as used herein, can refer to oriented films, wherein the orientation can be produced in one or more of a variety of manners.

As used herein, the phrase "outside layer" refers to the outer layer of a multilayer film packaging a product, which is furthest from the product relative to the other layers of the multilayer film.

The term "piercing fitment" encompasses the broad range of penetration elements known in the art.

As used herein, the term "polymer" (and specific recited polymers) refers to the product of a polymerization reaction, and is inclusive of homopolymers, copolymers, terpolymers, etc.

As used herein, the term "polymerization" can be inclusive of homopolymerizations, copolymerizations, terpolymerizations, etc., and can include all types of copolymerizations such as random, graft, block, etc. In general, the polymers in the films of the presently disclosed pouches can be prepared in accordance with any suitable polymerization process, including slurry polymerization, gas phase polymerization, high pressure polymerization processes, and the like.

The term "pouch" as used herein includes a pouch, a bag, or like containers, either pre-made or made at the point of bagging.

As used herein, the term "pouch fitment" refers to a means for accessing a container (such as a pouch) and can include, without limitation, valves, ports, port enclosure assemblies, and other means for accessing a container. Fitments provide ports for establishing fluid communication between the contents of a container and the outside environment.

As used herein, the term "pumpable" refers to the ability of a composition to be transported by gravity or by conventional mechanical or pneumatic pumping means from a storage vessel, such as a pouch.

As used herein, the term "rigid" refers to the relatively stiff and inflexible nature of the shaped materials of the presently disclosed subject matter while in a dry state.

As used herein, the term "seal" refers to any seal of a first region of a film surface to a second region of a film surface, wherein the seal is formed by heating the regions to at least their respective seal initiation temperatures. The heating can be performed by any one or more of a wide variety of manners, such as using a heated bar, hot air, infrared radiation, radio frequency radiation, etc.

As used herein, the term "substantially centrally located" and the like refers to the location of an item with respect to the midpoint of the item.

As used herein, the phrase "tie layer" refers to any internal film layer having the primary purpose of adhering two layers to one another. In some embodiments, tie layers can comprise a non-polar or slightly polar polymer having a polar group grafted thereon. In some embodiments, tie layers can comprise at least one member selected from the group consisting of: polyolefin and modified polyolefin, e.g., ethylene-vinyl acetate copolymer, modified ethylene-vinyl acetate copolymer, heterogeneous and homogeneous ethylene alpha olefin copolymer, and modified heterogeneous and homogeneous ethylene alpha olefin copolymer; more preferably, tie layers can comprise at least one member selected from the group consisting of anhydride grafted linear low density polyethylene, anhydride grafted low density polyethylene, homogeneous ethylene alpha olefin copolymer, and anhydride grafted ethylene-vinyl acetate copolymer.

As used herein, the term "upright" refers to a surface that stands roughly perpendicular to the surrounding base surface.

Although the majority of the above definitions are substantially as understood by those of skill in the art, one or more of the above definitions can be defined hereinabove in a manner differing from the meaning as ordinarily understood by those of skill in the art, due to the particular description herein of the presently disclosed subject matter.

III. The Dispensing System

III.A. Generally

The presently disclosed subject matter will now be described more fully hereinafter with reference to the accompanying drawings, in which some but not all embodiments are shown. Indeed, the presently disclosed subject matter can be embodied in many different forms and should not be construed as limited to the embodiments set forth herein. Like numbers refer to like elements throughout.

Figure 2:
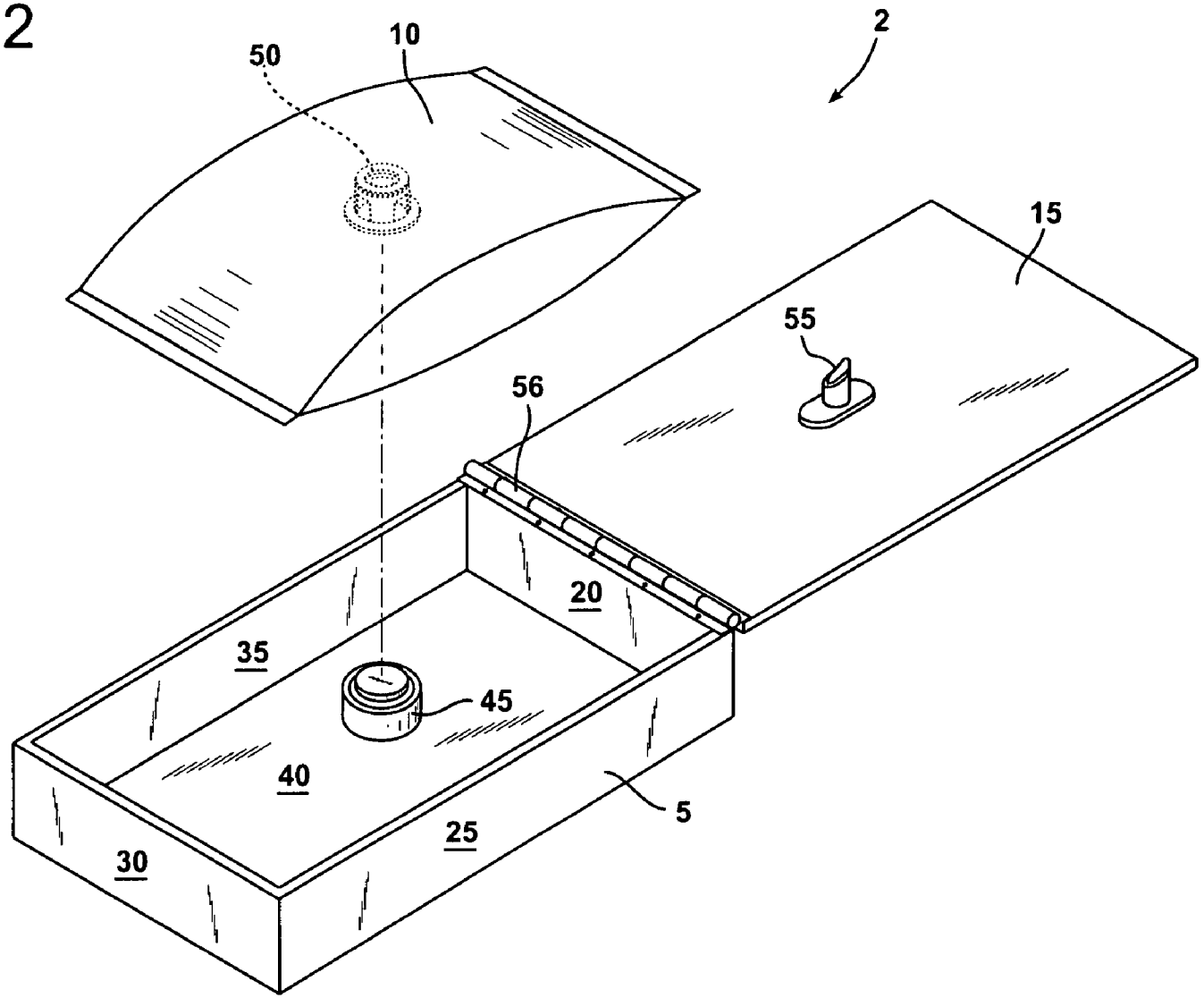

FIGS. 1 and 2 illustrate two embodiments of the general dispensing system of the presently disclosed subject matter. Particularly, the disclosed systems 1 and 2 comprise base 5, pouch 10 containing a pumpable product, and lid 15. Base 5 comprises four upright walls 20, 25, 30, and 35 and bottom portion 40. Bottom portion 40 comprises support means 45 that functions to support, center, and elevate pouch fitment 50 disposed within pouch 10. As set forth in more detail herein below, in some embodiments, pouch 10 can be packaged in a corrugate or other similar container prior to disposing the pouch within base 5. Lid 15 comprises piercing fitment 55 that can be mounted to the inside approximate center of lid 15. Alternatively, in some embodiments, piercing fitment 55 can be mounted to a location other than the approximate center of lid 15, so long as piercing fitment 55 and pouch fitment 50 can still align and/or interact to dispense the pouch contents. In some embodiments, lid 15 can comprise one or more guiding means 60 to guide lid 15 into proper placement within base 5. In the embodiment of FIG. 2, lid 15 is operatively connected to base 5 through connecting means 56 or other similar means (e.g., a hinge).

Thus, the disclosed dispensing system provides methods of storing and dispensing a pumpable product. Particularly, support means 45 allows inexperienced users to successfully dispense the contents of pouch 10. Support means 45 allows the user to properly center pouch 10 in base 5 such that the pouch fitment 50 is properly supported and elevated for piercing. Once lid 15 is positioned onto base 5, piercing fitment 55 pierces the film of pouch 10 at pouch fitment 50 such that the pouch contents can be dispensed. Once the contents of pouch 10 have been dispensed, the end user can detach and dispose of pouch 10, leaving base 5 and lid 15 ready for use on the next pouch. Alternatively, in some embodiments, the user can discard pouch 10, lid 15, and base 5 and purchase a new dispensing system.

III.B. Pouch

As indicated in FIG. 1, in practice pouch 10 is positioned in a substantially lay flat arrangement, such that pouch fitment 50 is disposed on an inner or outer surface of the pouch, and is supported by support means 45. Pouch 10 is positioned in a "face up" arrangement with pouch fitment 50 arranged so that it can be pierced by piercing fitment 55 when lid 15 is seated onto base 5. That is, in some embodiments, pouch fitment 50 can be sealed inside the pouch to the top film surface, facing piercing fitment 55.

FIG. 2 illustrates an alternate embodiment of the disclosed dispensing system. In FIG. 2, base 5 and lid 15 are operatively connected by connecting means 56. Such connecting means can include (but are not limited to) hinges, guide pins, panels, flanges, shafts, bearings, and combinations thereof. Thus, in practice, once pouch 10 is positioned in base 5, lid 15 can be swung over and/or maneuvered via a hinge or other connecting means into proper position on base 5.

Figure 3A:
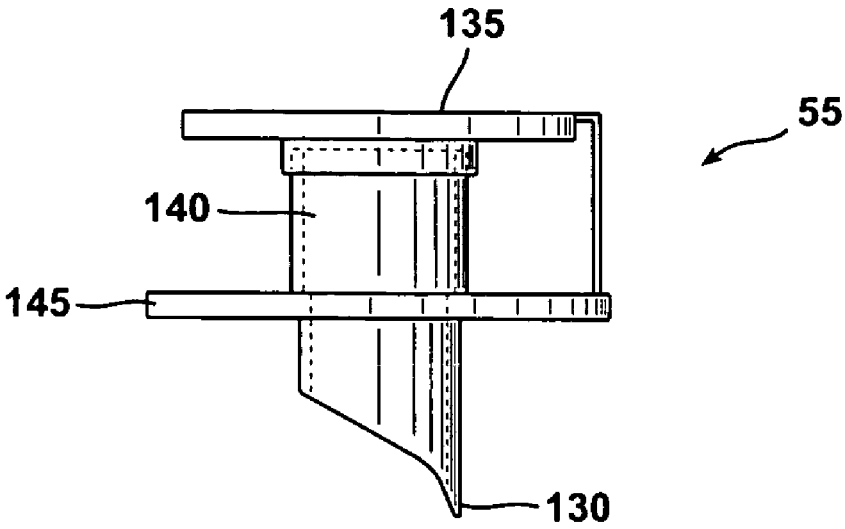
FIG. 3*a* is a perspective view of one embodiment of a piercing fitment that can be used in the disclosed system.
Figure 3B:
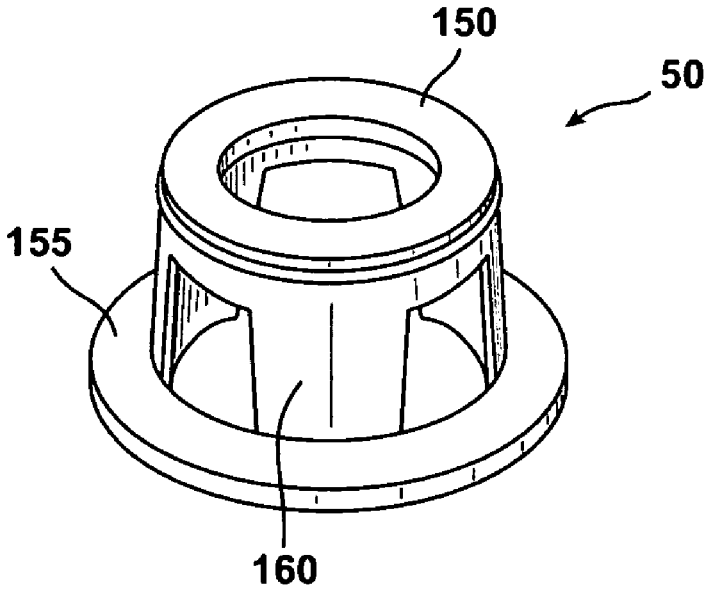
FIG. 3*b* is a perspective view of one embodiment of a pouch fitment that can be used in the disclosed system.

FIG. 3 illustrates one embodiment of piercing fitment 55 and pouch fitment 50. As would be appreciated by those of ordinary skill in the art, other such interacting fitments can be used, so long as a piercing fitment interacts with a pouch fitment. FIGS. 3*a* and 3*b* illustrate pouch fitment 50 and piercing fitment 55, respectively. The fitments can interlock such that pouch 10 is pierced when the fitments are joined together.

To elaborate, piercing fitment 55 comprises a piercing element 130 that functions to pierce the film of pouch 10 covering pouch fitment 50. In some embodiments, piercing fitment 55 can also comprise flip-top lid 135 or other suitable means to connect and/or interact with a pump. Flip top lid 135 can be opened to allow a pump to access and thus dispense the pumpable product from the piercing fitment and the pouch fitment. When closed, flip top lid 135 can interlock with column 140 to prevent leakage of the pouch contents. Piercing fitment 55 can also comprise a means for connecting to lid 15. For example, in FIG. 3*a*, piercing fitment 55 comprises ledge 145 that can be secured to lid 14 by adhesives or other suitable means. Accordingly, lid 15 can comprise piercing portion 130 on the bottom face (the face positioned toward pouch 10) and flip top lid 135 for accessing a pump on the top face of the lid. In some embodiments, ledge 145 can also be used as a means to properly position the depth of piercing fitment 55 within pouch fitment 50. Particularly, the width of pouch fitment 50 can be configured so that piercing element 130 can slide into top ring 150, but is too narrow to house ledge 145.

As mentioned herein above, pouch fitment 50 can be internal or external. When used as an internal fitment, top ring 150 can be sealed or connected to one surface of pouch 10. Outer ring 155 and pouch fitment base 160 are thus located within pouch 10, i.e., on the pouch face facing piercing fitment 55. To pierce, piercing element 130 pierces the film of pouch 10 in the area located within top ring 150 of pouch fitment 50. Top ring 150 can also be suitably configured to allow piercing fitment 55 to interlock with pouch fitment 50 using methods well known in the art.

Thus, the fitment assembly can comprise a locking mechanism adapted to secure piercing fitment 55 to pouch fitment 50 as a result of a pushing force exerted on pouch fitment 50 when lid 15 is seated onto base 5. Particularly, piercing fitment 55 can be in piercing engagement with pouch fitment 50. The locking mechanism can comprise a recessed portion on the piercing end of piercing fitment 55 adapted to cooperate with the elements of the pierceable portion of pouch fitment 50 to prevent unwanted spillage. Thus, fitments 50, 55 can interlock to stabilize and create an airtight and liquid-tight seal to prevent leakage at the fitment site. Accordingly, pouch 10 can be equipped with pouch fitment 50 adapted to cooperate with piercing fitment 55 to allow discharge of the pouch contents from pouch 10.

Figure 4:
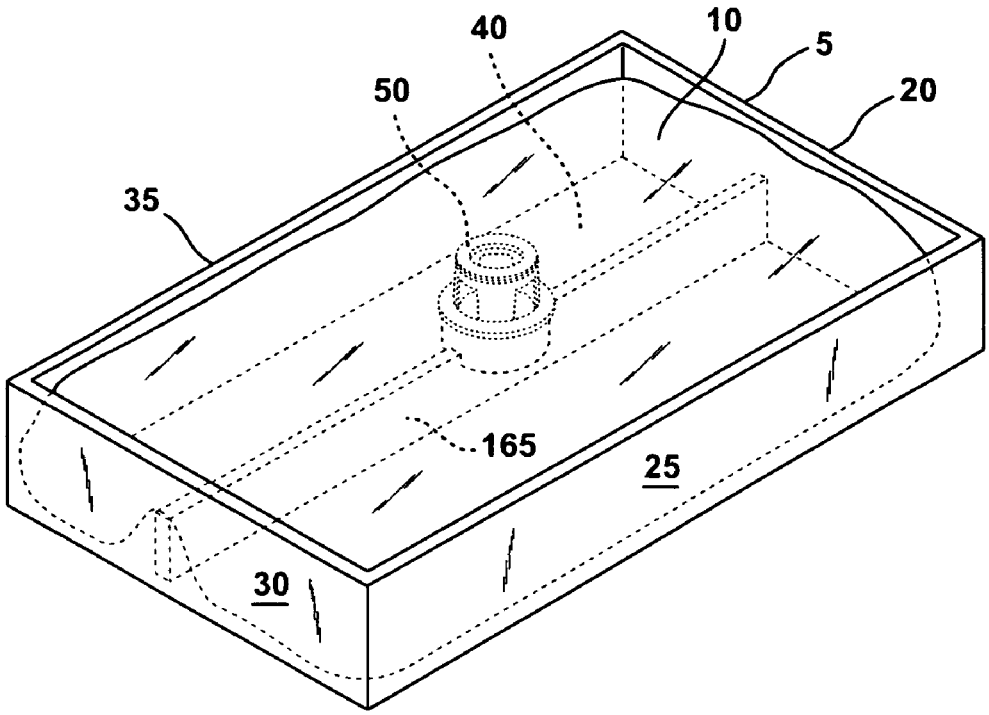
FIG. 4 is a perspective view of one embodiment of a pouch positioned on a support means in the disclosed system.
Figure 5:
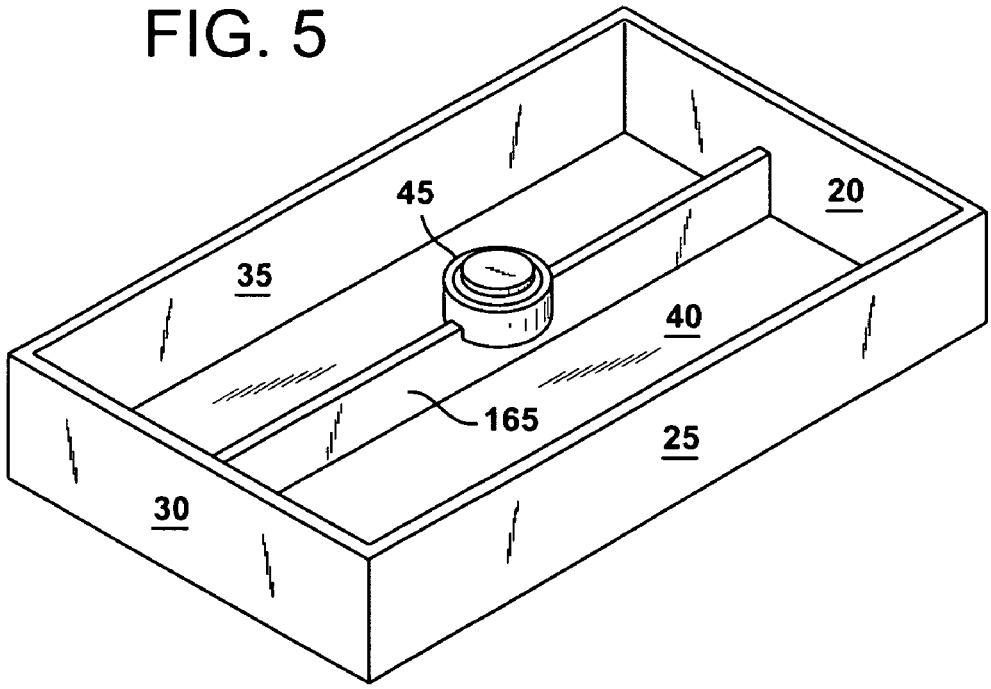
FIG. 5 is a perspective view of one embodiment of a support means used in the disclosed system.

Filled pouch 10 can be inserted into base 5 as shown in FIG. 4, and the lay flat arrangement maintained by support means 45. Particularly, pouch 10 can be positioned in base 5 with pouch fitment 50 in a "face up" arrangement to allow access to piercing fitment 55 located in lid 15. Support means 45 is secured to base 5 and configured to match with pouch fitment 50 such that the pouch fitment is secured, centered, and raised into proper piercing position. FIG. 5 illustrates one embodiment of support means 45. In FIG. 5, support means 45 is elevated from bottom face 40 of base 5 by means of beam 165 to gain height. However, it is not necessary in all embodiments to elevate support means 45. In addition, in some embodiments, alternate means of elevating support means 45 can be employed, such as (but not limited to) a block adhered to the bottom portion of support means 45, and other such means. Support means 45 can be in any shape so long as it functions to elevate, support, and properly position pouch fitment 50. However, in some embodiments, support means 45 can be circular in shape and indented to match outer ring 155 of pouch fitment 50.

Thus, support means 45 allows a user to easily place pouch 10 in proper position so that pouch fitment 50 can be accessed by piercing fitment 55 located in lid 15. In addition, the pouch position can be maintained by means well known in the art. For example, in some embodiments, pouch 10 can be secured directly to base 5 by an adhesive applied to the outer surface of the pouch in contact with the base, to reduce movement of the filled pouch within the base.

In some embodiments, there can be situations where pouch fitment 50 is properly centered, raised, and supported by pouch fitment 45, but a user inadvertently improperly places the pouch within base 5. In such situations, so long as pouch fitment 50 is properly placed, dispensing can still be accomplished. Particularly, even if pouch 10 is improperly positioned in base 5, so long as pouch fitment 50 is positioned onto support means 45, when lid 15 is placed onto base 5, piercing fitment 55 will interlock with pouch fitment 50 to pierce pouch 10 and allow dispensing to occur. Thus, the disclosed dispensing system is user-friendly and requires little (if any) training prior to dispensing.

Figure 6B:
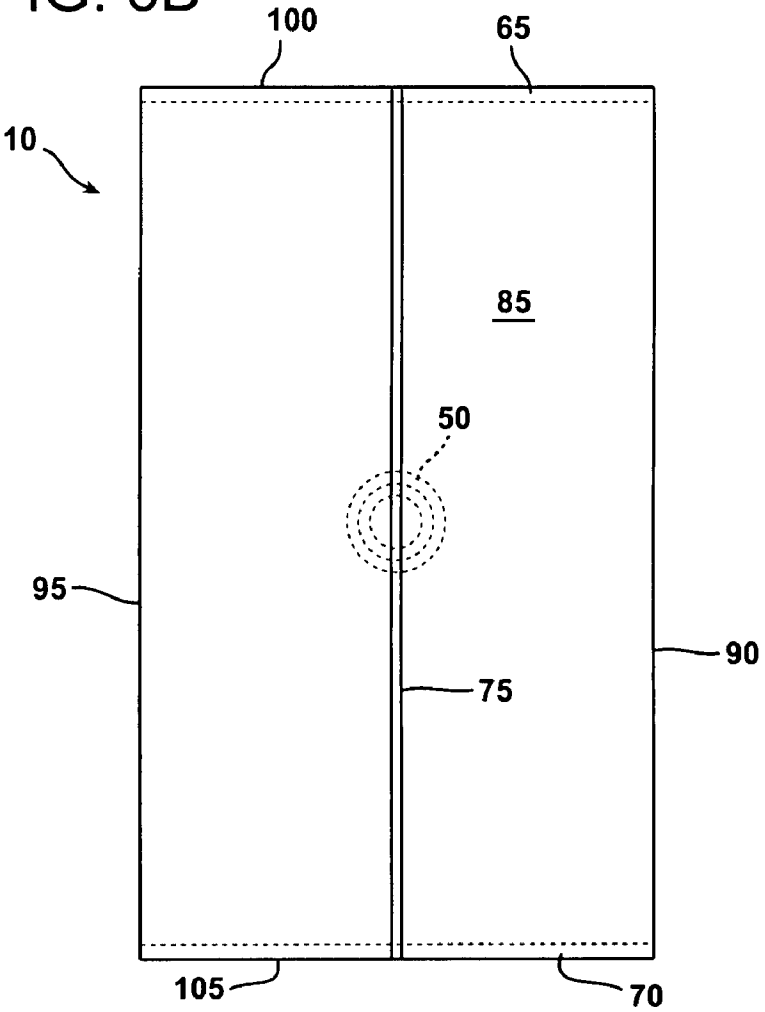
FIG. 6*b* is a bottom plan view of the pouch of FIG. 6*a*.
Figure 6A:
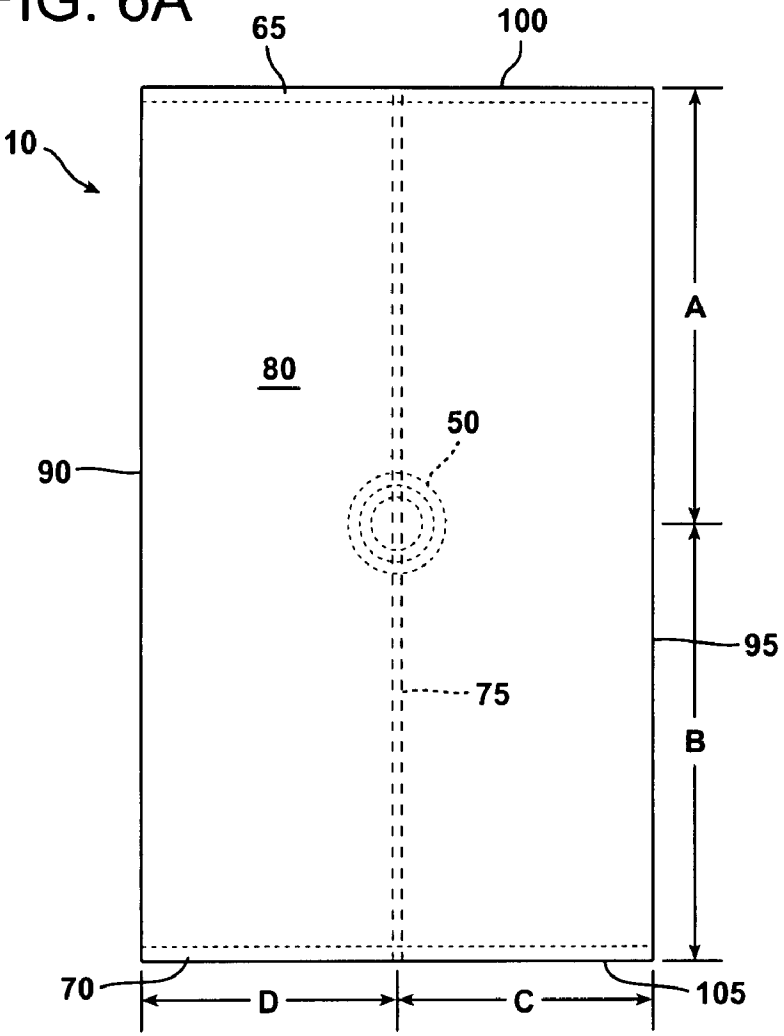
FIG. 6*a* is a top plan view of a pouch in its sealed and filled condition, having a substantially centrally located fitment.

Looking at FIGS. 6*a* and 6*b*, pouch 10 can include first transverse seal 65, second transverse seal 70, and longitudinal seal 75. The various seals can be made by heat sealing, radio frequency, ultrasonic sealing, or any of a wide variety of methods known to those of ordinary skill in the art. The width of the seals can be from about 2 to about 20 millimeters, although other sealing geometries are possible and within the scope of the presently disclosed subject matter. Pouch 10 can include a first end and a second end, first wall 80 having an outer surface and an inner surface, and second wall 85 having an outer surface and an inner surface. Pouch 10 can also include first side edge 90, second side edge 95, first transverse edge 100, and second transverse edge 105. Pouch 10 can also include a longitudinal seal disposed between the first side edge and the second side edge, and extending from the first transverse seal to the second transverse seal. Pouch fitment 50 can be attached to the inside or outside of first wall 80 and can be substantially centrally disposed between the first and second transverse edges 100, 105 of the pouch. First and second transverse edges 100, 105 are defined by the outer longitudinal extremities of first transverse seal 65 and second transverse seal 70, respectively. In some embodiments, unsealed pouch material can be present between the outer edges of a transverse seal and the actual respective transverse edges of the pouch itself. Such embodiments are also contemplated within the scope of the presently disclosed subject matter.

As represented in FIG. 6*a*, in some embodiments, pouch fitment 50 can be disposed approximately halfway between first and second transverse edges 100, 105 such that distances "A" and "B" are approximately equal in length. However; in some embodiments, the distances "A" and "B" can be of unequal lengths, such as in J-fold pouches or other pouches well known in the art. The practical limits are those imposed by base 5. It should be noted that the width of pouch 10 represented by lengths "C" and "D" is such that C can be approximately equal to D. It will be appreciated that lengths A and B and C and D are not always approximately equal in length and can vary according to the specific use desired.

Thus, in some embodiments, pouch fitment 50 can be somewhat off-center laterally, i.e., distance "C" can be less than or greater than distance "D". In some embodiments, the difference in distance between "C" and "D" can be less than or equal to 50%; in some embodiments, less than or equal to 40%; in some embodiments, less than or equal to 30%; in some embodiments, less than or equal to 20%; and in some embodiments, less than or equal to 10%. Thus, in some embodiments, the difference in distance between the fitment and the first transverse seal and the second transverse seal can be less than or equal to about 50%, 40%, 30%, 20%, or 10% of the total distance between the seals.

For example, if "C" is 7.5 centimeters long, "D" can be 7.5 centimeters long as well. However, in some embodiments, "C" can be 9 centimeters long, while "D" is 6 centimeters long, corresponding to a difference in length, between "C" and "D", of 50%. The practical limits can be those imposed by the location of piercing fitment 55 used and/or the effectiveness of pouch fitment 50 in allowing the flow of pumpable material out through a pump device. For example, in some embodiments, it is envisioned that pouch fitment 50 can be disposed on or near a side edge. Particularly, in some embodiments, the distance in difference between the fitment and the first side edge and the distance between the fitment and the second side edge is less than or equal to about 50% of the total distance between the first and second side edges.

Although an internal fitment (i.e., embodiments wherein the fitment is disposed on the inside surface of the pouch) is depicted in the figures, a suitable external fitment can also be used in the disclosed dispensing system. Thus, pouch fitment 50 can be adhered to pouch 10 by any suitable means (such as, for example, adhesives or by heat sealing) to the inner and/or outer surface of first wall 80.

Figure 7:
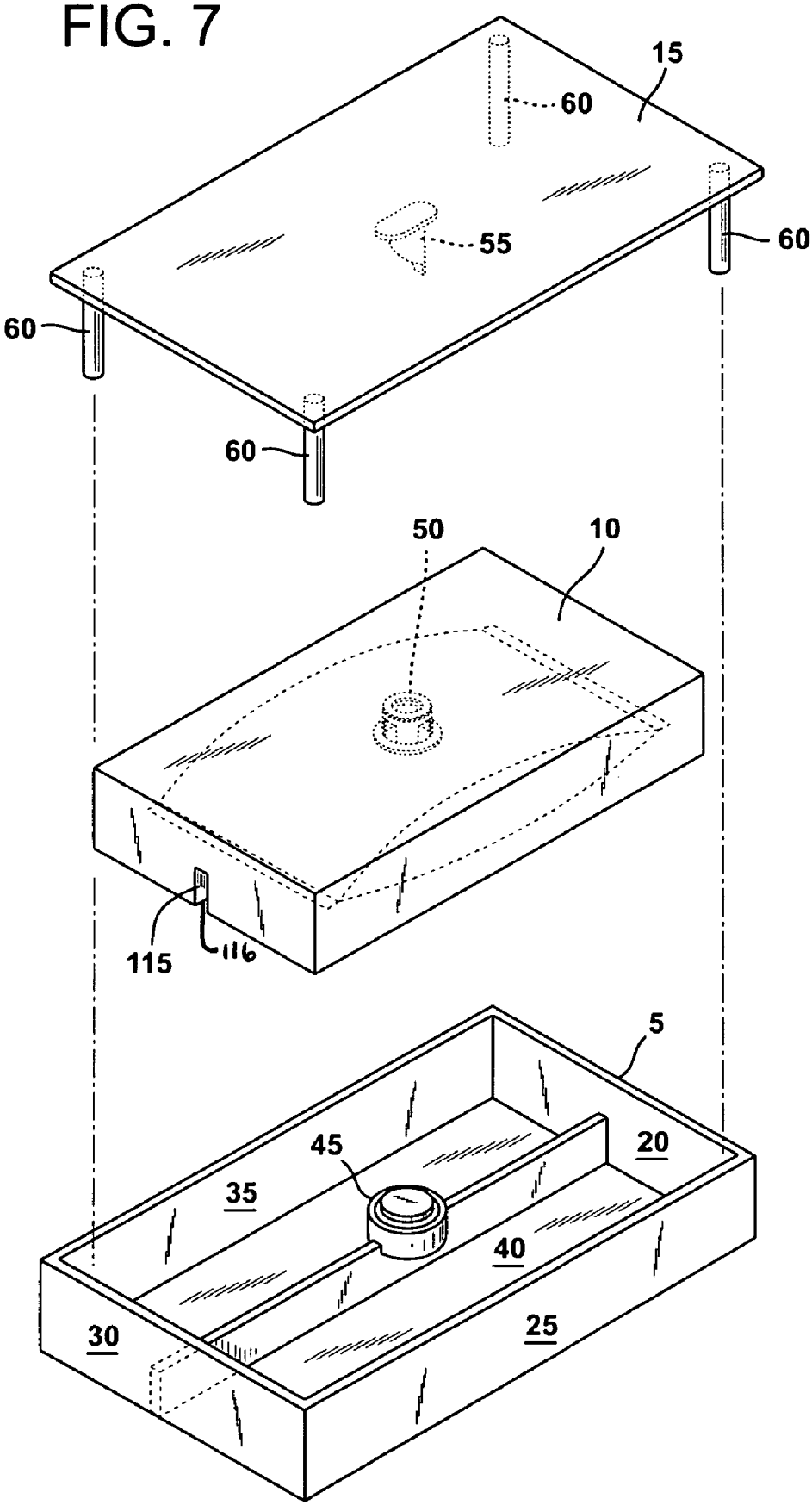
FIGS. 7 and 8 are perspective views of systems for dispensing a pumpable product.
Figure 8:
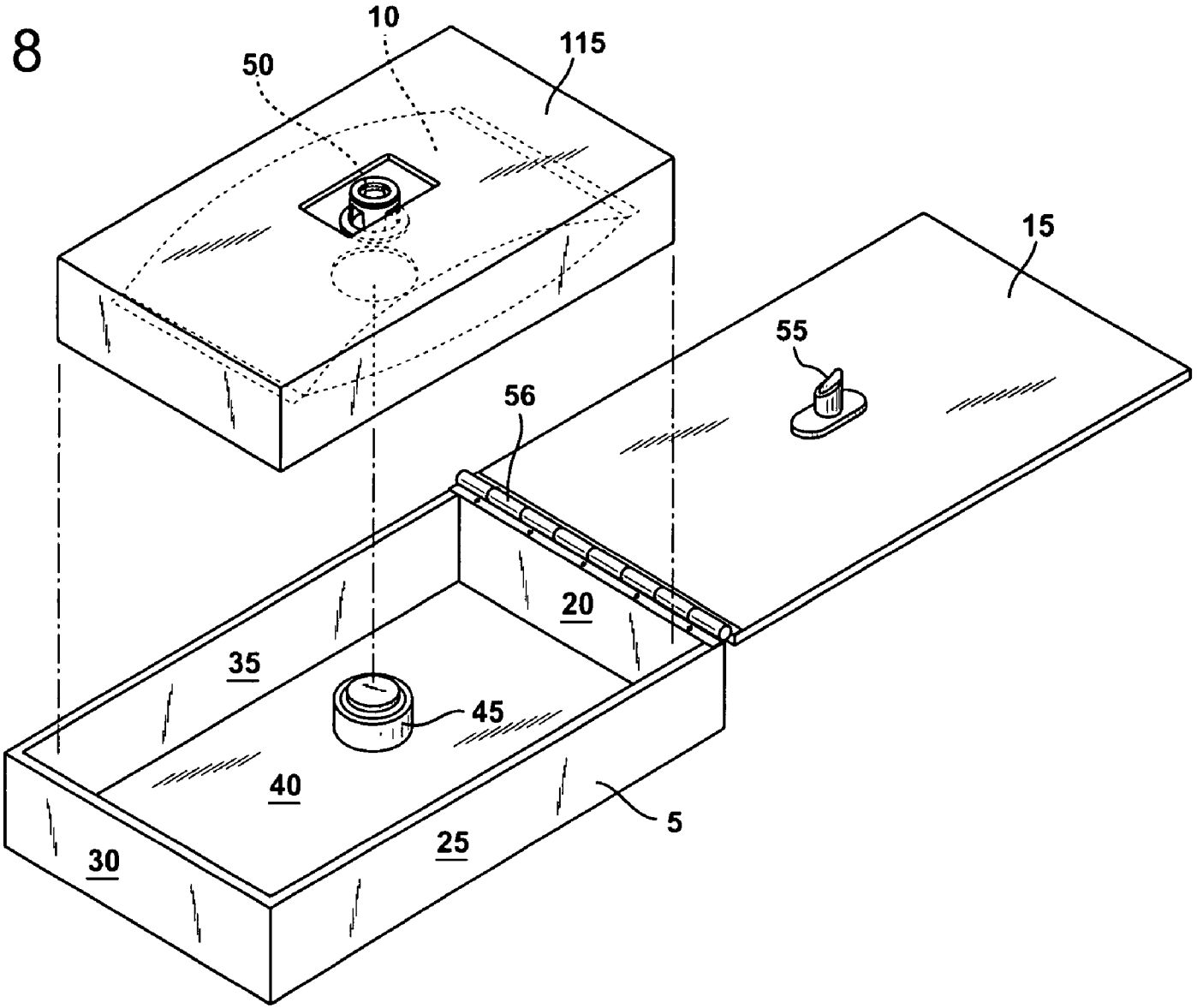

In some embodiments, as depicted in FIGS. 7 and 8, pouch 10 can be packaged in a corrugate or other container 115 prior to positioning in base 5. In some embodiments, container 115 can comprise indented portion 116 designed to allow the container to fit into base 5 comprising beam 165. Thus, in the embodiment depicted in FIG. 7, indented potion 116 allows container 115 to properly fit into base 5. However, indented portion 116 is not required in the disclosed system. For example, in FIG. 8, pouch 10 is packaged in container 115 (without an indented portion 116) prior to insertion in base 5. In these embodiments, support means 45 is located directly on bottom face 40 of base 5. Support means 45 functions to support pouch fitment 50 by means of a cutout in container 115 that allows access to the fitment. The container also can comprise one or more additional cutouts that allow piercing fitment 45 to access the pouch fitment.

Container 115 can be constructed from a wide variety of materials, including (but not limited to) cardboard, paperboard, plastic, wood, and the like. The dimensions of container 115 are not limited, and can be dictated by the dimensions of base 5. Pouch 10 can be positioned in container 115 in a lay flat arrangement as depicted in FIGS. 7 and 8, or can be folded. To elaborate, pouch 10 can be folded in a substantially U-shaped arrangement within container 115 and pouch fitment 50 located on an outside surface of the pouch (i.e., pouch fitment 50 can be an external fitment). Pouch fitment 50 is centered, elevated, and supported by container 115. Particularly, pouch fitment 50 is held into place by the top face of outer container 115, through a cut out or some other hole designed to lock the pouch fitment into proper position and support it. Lid 15 can then be positioned directly on the top face of container 115. As set forth above, lid 15 comprises piercing fitment 55 located on the inside surface such that when lid 15 is placed on the top face of container 115, piercing fitment 55 pierces pouch fitment 50. A pump can be integrally located within lid 15, or a separate pump can be connected to lid 15 to dispense the pouch contents.

Figure 9A:
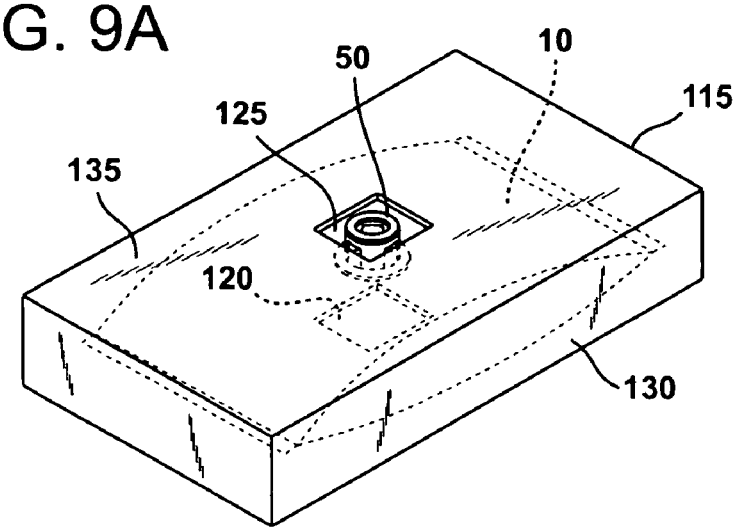
FIG. 9*a* is a perspective view of a container comprising a pouch of the disclosed system.
Figure 9B:
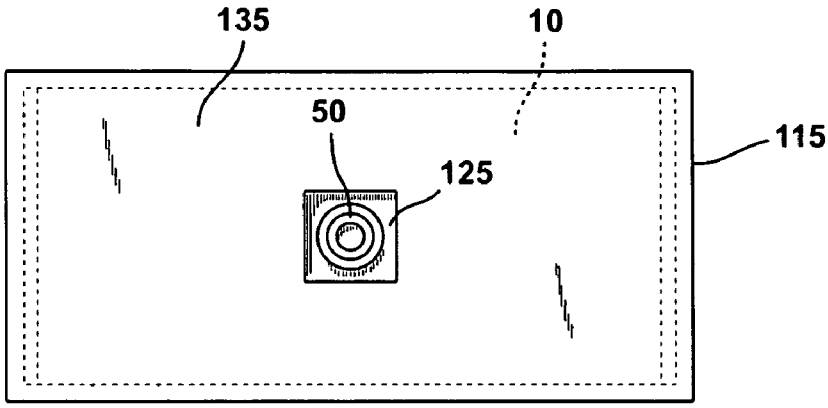
FIG. 9*b* is a top plan view of the container of FIG. 9*a*.
Figure 9C:
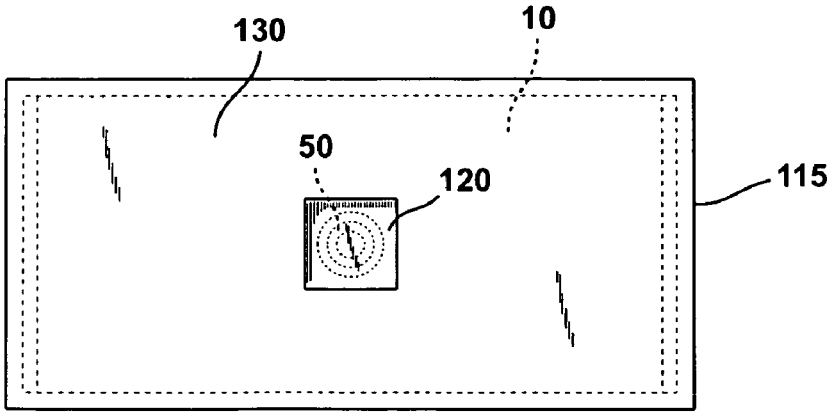
FIG. 9*c* is a bottom plan view of the container of FIG. 9*a*.

FIG. 9 illustrates one embodiment of container 115 housing pouch 10. In some embodiments, container 115 comprises bottom cutout 120 located on bottom face 130 of the container. FIGS. 9*b* and 9*c* are top and bottom plan views, respectively, of container 115 packaged with pouch 10. Bottom cutout 120 allows support means 45 to access pouch fitment 50. Thus, when container 115 is positioned in base 5, bottom cutout 120 allows pouch fitment 50 to be supported, centered and elevated by support means 45. In some embodiments, container 115 comprises top cutout 125 located in top face 135 of the container. Top cutout 125 allows pouch fitment 50 to be accessed by piercing fitment 55 once lid 15 is positioned on base 5. Bottom and top cutouts 120 and 125 can be in any suitable shape, so long as the cutouts allow access to pouch fitment 50.

In some embodiments, bottom cutout 120 and/or top cutout 125 can be created from perforated or otherwise weakened knock-out areas. Specifically, the perimeter of bottom cutout 120 and/or top cutout 125 can be perforated or weakened to allow for the easy opening and removal of the portions of container 115 covering the cutouts. Thus, portions of container 115 can be lifted upwardly or downwardly to tear the perforation and thus create bottom cutout 120 and/or top cutout 125. In this way, a predefined, perforated area of opening provides a clean and organized means for providing access to pouch fitment 50 and support means 45. Further, the perforations allow clean, predictable edges for bottom cutout 120 and/or top cutout 125.

Packaging pouch 10 in container 115 prior to positioning within base 5 allows users to properly position pouch 10 in base 5. Container 115 can be configured with dimensions such that the container simply snaps into proper position in base 5. Container 115 also adds another level of stability to pouch 10, maintaining proper position, but still allowing pouch fitment 50 to be supported, centered, and elevated by support means 45.

Pouch 10 can be made from any suitable material, and in some embodiments can be made from a thermoplastic material (including, for example, materials polymeric in composition), with a thickness of between about 0.1 and 100 mils. However, the film used to construct pouch 10 can have any total thickness desired, so long as the film provides the desired properties, e.g., optics, modulus, seal strength, etc., for the particular packaging operation in which the film is used.

In some embodiments film materials suitable for use in pouch 10 can include, but are not limited to, olefin or amide polymers or copolymers. The film can be manufactured by thermoplastic film-forming processes known in the art (e.g., tubular or blown-film extrusion, coextrusion, extrusion coating, flat or cast film extrusion, and the like). A combination of these processes can also be employed.

The film can be oriented or non-oriented. In some embodiments, the film can be oriented in either the machine direction (i.e., longitudinal), the transverse direction, or in both directions (i.e., biaxially oriented) in order to enhance the optics, strength, and durability of the film. If the film is oriented, it can be heat set or annealed after orientation to reduce the heat shrink attribute to a desired level or to help obtain a desired crystalline state of the film.

In some embodiments, the film can comprise one or more polymeric materials in a barrier layer to serve as a barrier to gases and/or odors. Such barrier layers can include, but are not limited to, ethylene/vinyl alcohol copolymer (EVOH), polyvinylidene dichloride (PVDC), vinylidene chloride copolymer such as vinylidene chloride/methyl acrylate copolymer, polyamide, polyester, polyacrylonitrile (available as Barex™ resin), or blends thereof. Oxygen barrier materials can further comprise high aspect ratio fillers that create a tortuous path for permeation (e.g., nanocomposites). The oxygen barrier of materials can be further enhanced by the incorporation of an oxygen scavenger.

In some embodiments, the disclosed film can comprise one or more bulk layers to increase the abuse-resistance, toughness, modulus, etc., of the film. In some embodiments, the bulk layer can comprise polyolefin, including but not limited to, at least one member selected from the group consisting of ethylene/alpha-olefin copolymer, ethylene/alpha-olefin copolymer plastomer, low density polyethylene, and linear low density polyethylene.

In some embodiments, the presently disclosed film can include one or more tie layers. Such tie layers can include, but are not limited to, one or more polymers that contain mer units derived from at least one of $C_2$-$C_{12}$ alpha olefin, styrene, amide, ester, and urethane. In some embodiments, the tie layer can comprise one or more of anhydride-grafted ethylene/alpha olefin interpolymer, anhydride-grafted ethylene/ethylenically unsaturated ester interpolymer, and anhydride-grafted ethylene/ethylenically unsaturated acid interpolymer.

In some embodiments, the film can comprise one or more abuse layers that serve to resist abrasion, puncture, and other potential causes of reduction of package integrity, as well as potential causes of reduction of package appearance quality. Particularly, the film should have the required degree of tolerance to pinching and exposure to sharp edges, resulting from contact with the edges of the panels of base 5. Abuse layers can comprise any polymer, so long as the polymer contributes to achieving an integrity goal and/or an appearance goal. In some embodiments, the abuse layer can comprise at least one member selected from the group consisting of polyamide, ethylene/propylene copolymer; in some embodiments, nylon 6, nylon 6/6, amorphous nylon, and ethylene/propylene copolymer.

The polymer components used to fabricate films according to the presently disclosed subject matter can also comprise appropriate amounts of other additives normally included in such compositions. For example, slip agents (such as talc), antioxidants, fillers, dyes, pigments and dyes, radiation stabilizers, antistatic agents, elastomers, and the like can be added to the disclosed films.

There is generally no limit to the number of layers used for the film structure provided that the various functional requirements are met. Accordingly, the film can comprise 1, 2, 3, 4, 5, 6, 7, 8, 9, 10, 11, 12, 13, 14, 15, 16, 17, 18, 19, or 20 layers.

In some embodiments, it is envisaged that pouch 10 can be produced in various different sizes, depending on the product to be packaged. For example, a 0.5 pint to 5 gallon size (the dimensions of the pouch being adjusted to give the appropriate volume) can be fabricated. Thus, in some embodiments, pouch 10 can be prepared in 0.5, 1, 1.5, 2, 2.5, 3, 3.5, 4, 4.5, 5, 5.5, 6, 6.5, 7, 7.5, or 8 pint (1 gallon) sizes. In addition, 1, 1.5, 2, 2.5, 3, 3.5, 4, 4.5, and 5 gallon pouch sizes can also fall within the scope of the presently disclosed subject matter. Larger or smaller volumes are also contemplated and can be included within the presently disclosed subject matter. In addition, as would be readily apparent to one of ordinary skill in the art, the gallon measurements can easily be converted to liter or other suitable measurements.

Those skilled in the art will understand, after a review of the present application, that the particular shape and size of pouch 10 can be selected as needed to suit the particular product to be packaged. Likewise, in some embodiments, the pouch size and shape, and location of the fitments can be selected to suit existing pump systems.

III.C. Base

As depicted in FIGS. 1 and 2, base 5 is open at its top end and can receive through this opening pouch 10 filled with a pumpable product in such a condition that the pouch is positioned with pouch fitment 50 facing upwards (toward piercing fitment 55 of lid 15). With pouch 10 received in position, the top end of the dispenser is closed by lid 15. The lid can be fitted with a pump to dispense the contents of pouch 10.

Base 5 can be of rigid or semi-rigid construction with sufficient strength to resist deformation by the placement of pouch 10. Thus, base 5 can be constructed of wood, plastic, metal, glass, reinforced cardboard, or other similarly supportive materials. Other materials, including laminates and composites, can also be used. In some embodiments, the material itself may not necessarily provide the strength required to resist deformation, but base 5 instead can be assembled so as to provide sufficient strength to resist excessive deformation through principles of engineering well known to those of ordinary skill in the art, including the use of a rigid frame covered with a flexible material.

Base 5 can be constructed by hand or mechanically in any of a variety of ways known to one of ordinary skill in the art. For example, base 5 can be formed from a conventional unfolded blank used to construct a single piece tray-style box container. However, it will be understood that base portions with parts that are molded separately and then joined by any means known in the art can also be included in the presently disclosed subject matter.

Thus, in some embodiments, base 5 can be suitably formed by folding and sealing a pre-cut blank, which can be manufactured in bulk according to means well known in the art. The blank can be scored with fold lines to provide a plurality of panels. The plurality of panels can comprise four upright walls 20, 25, 30, and 35 and bottom portion 40. One of ordinary skill in the art would readily appreciate that these and a variety of other blanks of various shapes can be used to form base 5 in accordance with the presently disclosed subject matter. In some embodiments, base 5 can be manufactured using a process such as plastic extrusion, molding, and the like.

In some embodiments, base 5 can comprise materials suitable for printing, such that any desired graphics or printed materials can be placed thereupon. Such graphics or printed materials can include, but are not limited to, manufacturer's name, pouch contents, and the like. Such printing methods are known to those of ordinary skill in the art.

In some embodiments, base 5 can be rectangular in shape, have an overall planar configuration, and can include bottom face 40 and side edges 20, 25, 30, and 35. A plurality of score or fold lines can extend in parallel with respect to the sidewalls so that base 5 can be folded to have four upright walls and a bottom. In some embodiments, the panels of base 5 can be secured by, for example, applying hot-melt resin glue at specific locations, folding the body at the plurality of fold lines, and compressing at the glued panel locations. Those skilled in the art will understand, after a review of the present application, that the particular shape and size of base 5 can be selected as needed to suit the particular size and shape of pouch 10.

As mentioned hereinabove, pouch 10 comprises pouch fitment 50 for interlocking with piercing fitment 55 located on lid 15. As depicted in FIGS. 1 and 2, in order for the pouch fitment to be suitably accessed by piercing fitment 55, base 5 comprises an approximately centrally located support means to provide such access. Support means 45 can function to support, center and elevate pouch fitment 50. In some embodiments, support means 45 can be secured to bottom face 40 of base 5 by any means known in the art. For example, any of a wide variety of adhesives can be used.

In some embodiments, support means 45 can be constructed and manufactured in bulk according to means well known in the art. Suitable substrates from which support means 45 can be constructed include wood, plastic, metal, glass, reinforced cardboard, any other similarly supportive materials, or any combination thereof. Support means 45 can have any size or shape desired, so long as it functions to support, elevate, and center pouch 10. Particularly, in some embodiments, support means 45 can be configured as a raised circular portion that directly aligns with pouch fitment 50.

In some embodiments, base 5 can comprise one or more guiding means to fit or guide lid 15 into proper position. For example, lid 15 can comprise one or more guiding pins, hinges, springs, or the like that can align and fit into grooves located on base 5. Similar guiding means are known to those of ordinary skill in the art and are included in the presently disclosed subject matter.

III.D. Lid

As depicted in FIGS. 1 and 2, lid 15 can be approximately rectangular in shape and configured to seat onto base 5. Those skilled in the art will understand, after a review of the present application, that the particular shape and size of lid 15 can be selected as needed to suit the particular size and shape of pouch 10 and/or base 5. Thus, in some embodiments, lid 15 can match the shape of base 5.

Lid 15 can be of rigid or semi-rigid construction with sufficient strength to resist deformation. Thus, lid 15 can be made of wood, plastic, metal, glass, reinforced cardboard, or other similarly supportive materials. Other materials, including laminates and composites, can also be used to construct lid 15. In some embodiments, the material itself may not necessarily provide the strength required to resist deformation, but lid 15 instead can be assembled so as to provide sufficient strength to resist excessive deformation through principles of engineering well known to those of ordinary skill in the art, including the use of a rigid frame covered with a flexible material. Lid 15 can be constructed by hand or mechanically in any of a variety of ways known to one of ordinary skill in the art.

In some embodiments, lid 15 can comprise materials suitable for printing, such that any desired graphics or printed materials can be placed thereupon. Such graphics or printed materials can include, but are not limited to, manufacturer's name, pouch contents, and the like. Such printing methods are known to those of ordinary skill in the art.

Lid 15 can be transparent or opaque. Where it is transparent, it is possible to determine the quantity of pumpable product present in pouch 10 from outside the dispenser. Also, in some embodiments, a window or other see-through aperture in lid 5 can be formed to check the quantity of contents present in pouch 10.

As depicted in FIG. 2, lid 15 can be suitably attached to base 5. For example, in some embodiments, lid 15 can be attached to base 5 by means of a hinge or other like devices. Thus, in use, a user can simply rotate lid 15 through connecting means 56 (e.g., a hinge) and place it in proper position onto base 5. However, in some embodiments, lid 15 is separate from base 5 (i.e., no connecting means is present). In such instances, a user can simply manually position lid 15 onto base 5. In some embodiments, lid 15 can be guided onto base 5 by one or more guiding means 60. For example, as depicted in FIG. 1, lid 15 can comprise one or more pins, grooves, notches, and/or the like to assist users in positioning lid 15 on base 5. Alternatively, in some embodiments lid 15 can be a snap-on type lid, such that it can be positioned directly over base 5 and will snap securely into place.

As depicted in FIGS. 1 and 2, lid 15 comprises piercing fitment 55 attached to bottom face 140 (i.e., facing pouch fitment 50). Piercing fitment 55 can be constructed of wood, plastic, metal, glass, reinforced cardboard, or other similarly supportive materials. Further, piercing fitment 55 can be affixed to lid 15 by any suitable means known to those of ordinary skill in the art, including but not limited to, adhesives.

As depicted in the Figures, piercing fitment 55 of lid 55 has a piercing portion to contact, pierce, connect to, and/or interlock with pouch fitment 50. Thus, piercing fitment 55 can have a conical or piercing portion matched to pouch fitment 50. The piercing fitment can therefore terminate at an angle to facilitate puncturing of pouch fitment 50. The precise construction of the piercing portion of piercing fitment 55 can vary so long as it interacts with pouch fitment 30 to dispense pouch contents. In some embodiments, the piercing portion of piercing fitment 55 comprises a generally cylindrical stem topped with a pointed tip. The exact size and shape of the tip can depend on many factors, including the dimensions of pouch fitment 50, the materials used in the construction of pouch 10, and the type and amount of pumpable product contained therein, among others. Specific values for any of these factors in any embodiment are a matter of engineering design choice.

Once piercing fitment 55 is fully inserted into pouch fitment 50, the two can become locked together via a friction or snap-fitting mechanism. Such a mechanism prevents the piercing fitment from being pulled out of the pouch fitment once the assembly is in a dispensing state and also maintains a tight fit between piercing fitment 55 and pouch fitment 50 to prevent unwanted spillage of the pouch contents. In some embodiments, the dispensing system can comprise a dispensing mechanism in connected relationship with the piercing fitment. For example, the interior of piercing fitment 55 can be connected to a spigot, siphon, pump, tap, nozzle, hose, or combinations thereof, either directly or via an interior tube or other travelway.

Once the contents of pouch 10 have been dispensed, the end user can detach lid 15 and dispose of pouch 10, leaving base 5 and lid 15 ready for use on the next pouch. In some embodiments, the base and lid can be assembled and/or purchased pre-equipped with a pouch such that when the pouch contents are empty, pouch 10, base 5, and lid 15 can be discarded. In some embodiments, once the contents of pouch 10 are empty, pouch fitment 50 can be detached from piercing fitment 55 and base 5 and lid 15 retained.

III.E. Pump

A delivery mechanism, such as a pump, can be associated with the disclosed dispensing system to selectively dispense the contents of pouch 10. Such a pump device suitable for use with the disclosed dispensing system is not limited and can include any of a wide variety of commercially available models.

Figure 10:
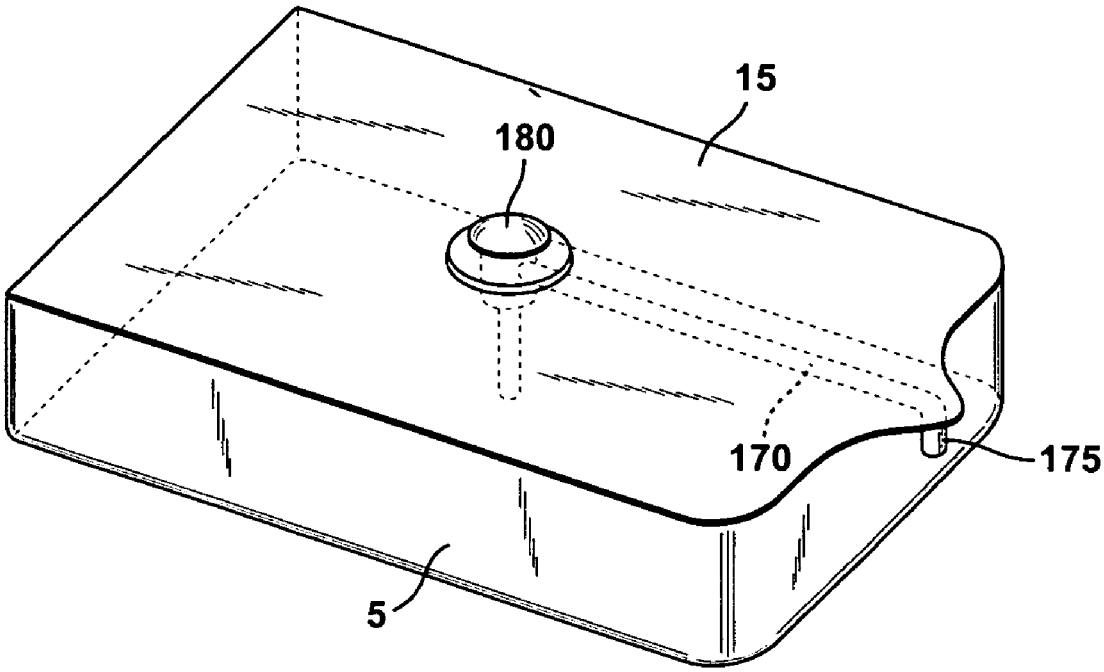
FIG. 10 is a perspective view of a system for dispensing a pumpable product.

For example, as depicted in FIG. 10, a pump can be housed within lid 15. To elaborate, in some embodiments, tubing 170 or other similar means can be used to connect piercing fitment 55 to dispensing port 175. The tubing can run to one edge of lid 15 to a dispensing unit. Thus, when button 180 or other similar means is pushed or activated, a dispensing mechanism, such as a spigot or other dispensing valve, can control the dispensing of the pumpable product from pouch 10. The dispensing mechanism can have any valve design convenient for dispensing fluid on demand. In some embodiments, the pump can be a simple button-operated or lever-operated valve that defaults to a closed position (through use of a spring or other biasing mechanism), and is opened only when the button or lever is moved against the biasing mechanism. Such an embodiment of a lever-operated valve is commonly used on coffee and water dispensers for home and commercial use. Dispensing mechanisms encompassing valves of various designs useful for dispensing from the dispensing apparatus are well known to those of ordinary skill in the art. In addition, in some embodiments, an external pump can be used with the disclosed dispensing system. Such external pumps are well known to those of ordinary skill in the art.

In the embodiments described above, the dispensing system is configured so that the pumpable product is dispensed upwardly to a pump or other means in connected relationship with the fitments. However, it is envisioned that in some embodiments, the dispensing system can be flipped over to allow pumpable product to flow and be dispensed downwardly. Thus, placing the fitment at the lowest point of the package can alleviate any issues that can arise with dispensing thicker products.

Beyond the simplest embodiments of the pump device above described, which can be particularly suited for use in simple and economical dispensing systems, many more capabilities are possible. For example, the pump can comprise a means of establishing metered flow, means of establishing dose volume, provisions for an electronic output firing signal, use of digital counters, and the like. In some embodiments, the pump can be remote such as those used in carbonated beverage mixing and dispensing systems. Such capabilities are well understood to those of ordinary skill in the art.

III.F. Pumpable Product

The presently used dispensing system can be used with a wide variety of pumpable products, including but not limited to, food items, beverage items, and personal care items. Food products suitable for use with the presently disclosed subject matter can include edible products, such as butters, catsup, cheese spreads, chutneys, coffee and other food or beverage extracts, cream, dairy products, dips, essential oils, flavorings, foods, frostings, fruit spreads, glazes, honey, horseradish, jams, jellies, marinades, mayonnaise, mustard, nutritional supplements, oils, preserves, pudding, relish, salad dressings, salsa, sauces (such as hot and pepper sauces, teriyaki sauce, dessert sauces, pesto sauces, pasta sauces, soy sauce, barbeque sauces, sweet and sour sauces, hot, or grilling sauces), seasoning blends, syrups, vinegars, vinaigrettes, or any other types of pumpable food items.

Beverages suitable for use with the presently disclosed subject matter can include, but are not limited to, carbonated beverages including soft drinks, coffee drinks, energy drinks, fruit and vegetable juices, hot chocolate, milk and other dairy beverages, sports beverages, tea, water, wine and other alcoholic beverages, and other type of pumpable natural and/or artificial flavored beverages.

The presently disclosed subject matter can also be used with a wide variety of personal care products, including but not limited to, body oils, body washes, bubble bath, cleaning products (including oils, floor cleaners, carpet cleaners, furniture cleaners, appliance cleaners, disinfectants, gels, glass cleaners, detergents, liniments, pastes, polishes, stain removers, allergen removers, sanitizing systems), colorants, conditioners, creams, deodorants, fabric conditioners, fabric softeners, hairdressings, hair treatments, hand soaps, insect repellants, laundry products, lotions, lubricants, medications, mineral solutions, moisturizers, mouthwashes, ointments, petroleum jellies, pharmaceuticals, salves, shampoos, shaving creams, soaps, sunscreens, and any other types of pumpable personal care items.

Thus, the presently disclosed subject matter can be used for dispensing pumpable products including low viscosity fluids (e.g., juice and non-carbonated beverages), high viscosity fluids (e.g., condiments and sauces), and the like. Non-food products such as fertilizers, motor oil and engine additives, wet cosmetics, medicaments, and the like can also be beneficially packaged and dispensed in the presently disclosed system. One of ordinary skill in the art can appreciate that the above list is not exhaustive, and the presently disclosed system and methods can be used in packaging applications not listed hereinabove.

IV. Methods of Using the Disclosed System

In use, pouch 10 can be inserted in a number of different ways into base 5 so long as support means 45 can be aligned with pouch fitment 50. For instance, as set forth in detail hereinabove, pouch 10 can be packaged in a cardboard or other container 115 prior to insertion in base 5. The protective packaging can fit directly into base 5. Container 115 can be configured to allow pouch fitment 50 to be elevated, centered, and supported by support means 45 by a cutout or other such devices. The protective package can be snapped into base 5 or can be simply placed and held in base 5 by the measurements of the base.

However, in some embodiments, pouch 10 can be inserted directly into base 5 by the user. When pouch 5 is inserted into base 5, the pouch is configured with pouch fitment 50 facing upwards. Accordingly, the pouch can be positioned such that when a user places pouch 10 into base 5, pouch fitment 50 is automatically centered, elevated and supported by support means 45. Thus, users require no prior teaching as to the proper position of the pouch.

When lid 15 is seated onto base 5, piercing fitment 55 can interact with pouch fitment 50. Particularly, pouch fitment 50 is positioned by support means 45 in the proper position to receive piercing fitment 55. Pouch fitment 50 comprises an opening to receive the piercing portion of piercing fitment 55. A force is applied to lid 15 such as to press the piercing fitment against the film covering pouch fitment. The piercing portion slides against the inside surface of pouch fitment 50 and can form a substantially hermetic seal between the fitments. In some embodiments, the fitments are locked together into position. Once the contents of pouch 15 have been dispensed, the end user can open lid 15 to remove and dispose of pouch 10.

The process of penetrating pouch 10 with the piercing fitment 55 can take many forms depending on the embodiment of the dispensing apparatus. In some embodiments, the piercing fitment is simply hand-driven into pouch fitment 50. In such instances, base 5 can be held in one's hands or placed on a convenient work surface. As discussed above, base 5 can be sized and shaped so that filled pouch 10 has similar external volume to the internal volume of base 5. Therefore, if pouch 10 is placed in base 5, the pouch should be sufficiently constrained to allow penetration by piercing fitment 55 when forced against pouch fitment 50.

In some embodiments, piercing fitment 55 can work with an extension screw, piston, bladder or other similar drive mechanism that can create a force that pushes pouch 10 and/or pouch fitment 50 against piercing fitment 55. For example, pouch 10 can be placed in base 5 and lid 15 positioned thereupon without the pouch being penetrated by the piercing fitment. A force can then be generated against pouch 10 in the direction of piercing fitment 55 using a crank, a screw, a spring, a bladder, or a person's hands. Many arrangements of such a drive mechanism can be engineered, as would be understood by one of ordinary skill in the art.

V. Advantages of the Disclosed System

The presently disclosed system can be used to economically package and dispense a wide range of pumpable materials. Pouch 10 provides an easy indicator to the end user (based on their pre-learned methods of removing caps or seals from actual cans, bottles, and/or tubes) as to how the contents of the pouch can be accessed. In some embodiments, graphics on pouch 10, base 5, and/or lid 15 can also help the user to correctly apply the pumpable material onto a desired object by providing a visual indicator as to the precise location of the exit orifice of the dispenser. Further, the pouches, lids, and bases can be manufactured economically, thereby allowing producers to offer product to end users with a more significant price reduction compared to those pouches and systems that have been available in the past.

Currently, flexible pouches are only rarely used for home dispensing of products, such as fabric softeners, cooking oils, etc. These pouches typically have a pump or spout that is time consuming to use and most often is located at the bottom of the package and must be placed at the edge of the counter to dispense the product. The presently disclosed subject matter allows accurate dispensing of the product at a height convenient to the end user. The dispensing opening will not have to be located over the edge of a counter.

In addition, the disclosed dispensing system comprises a base that can function to hold and store the pouches in an organized manner. Base 5 and lid 15 are advantageous in storing the pouches in an effective and space-friendly manner. Thus, the disclosed system comprises a system that can be neatly stacked during storage or while in use. The system allows the end user to make the best use of limited storage space by allowing for the stacking of the dispensers. In comparison, most liquid or pumpable end user products that are dispensed over time are contained in bottles. The bottles are heavy (adding to freight costs during distribution), not stackable, and have limited label area for graphics.

In addition, the disclosed dispensing system can operate in high hygienic demanding environments, and can achieve substantially complete evacuation of the contents of the pouch and prevent air from being drawn thereinto.

The fitments and pump assembly of the presently disclosed subject matter can advantageously seal the pumpable product in the pouch throughout the shelf life and multiple dispensing of the product. As a result, non-acid products, such as milk-based products, do not require refrigeration during shelf life or usage of the product. However, for certain products it can be desirable to refrigerate the product to provide a better taste, to provide the product at a desired or customary temperature, and/or for any of numerous reasons that are currently known or that later become known. Accordingly, in some embodiments, the presently disclosed system can be used in residential refrigerators and can be easily engaged with dispensing fitments built in by the refrigerator manufacturer, without the need for a pump. For example, it can be possible to gravity-feed juice or other beverages from the pouch or system within the refrigerator to a dispensing area in the door. Thus, the disclosed system provides for extended shelf-life of the contents within the pouch, and allows the pouch to be non-refrigerated during storage and throughout the usage of the pouch (i.e., the pouch can remain non-refrigerated from the first to the last dose dispensed from the pouch).

One advantage of the presently disclosed system is that no manual refilling of the packaged product is necessary. When a pouch is empty, the lid is removed from the base or opened if the lid is hinged so that the pouch can be removed and discarded. In some embodiments, the carton can also be discarded if used for distribution. A new pouch filled with a pumpable product and fitment can then be installed. The pouch fitment is precisely held in position by the support means in the base such that the dispensing fitment and the pouch fitment are easily and precisely aligned. In some embodiments wherein the pump is pre-installed in the system, the disclosed system requires no handling of the pouch by the end user to make connections and/or to place in a secondary dispenser. Accordingly, the end user merely aligns and/or pierces the pouch fitment with the pump fitment to dispense the contents of the pouch. Alternatively, the system can be purchased pre-equipped with a pump such that the end user merely activates the pump to dispense the pouch contents.

The labor-intensive cleaning of the product well of prior art dispensing systems is substantially eliminated because the pouch material shields the internal surface of the base and lid from direct content with the pumpable product. In addition, when the pouch contents are empty a new system comprising a filled pouch (or in some embodiments filled pouch and carton) can replace the empty pouch. Further, optimal product freshness is promoted by maintaining the product in an enclosed pouch throughout its useful life.

The dispenser of the presently disclosed subject matter can be purchased fully assembled and ready to use, thereby entitling a user to fill the pouch without first having to assemble part of all of the container. Moreover, the container can be filled using an automated filling unit, and can be easily collapsed and disposed of when empty.

What is claimed is:

1. A dispensing system for dispensing a pumpable product from a pouch comprising:

a) a dispenser comprising:

(i) a base having a plurality of upright walls and a bottom portion, said bottom portion comprising a support; and (ii) a lid for positioning onto said base, said lid comprising a piercing fitment mounted to the inside of the lid;

b) a pouch disposed within said dispenser, said pouch comprising:

i) a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal; and ii) a pouch fitment disposed on the first wall of the pouch, wherein the pouch is positioned in the base fitment-side facing up;

wherein said pouch contains the pumpable product; and wherein said support of said base functions to support, center, and elevate said pouch fitment sealed within said pouch.

2. The dispensing system of claim 1, further comprising a dispensing mechanism in connected relationship with said piercing fitment.

3. The dispensing system of claim 2, wherein said dispensing mechanism is selected from the group consisting of: a spigot, siphon, pump, tap, nozzle, hose, or combinations thereof.

4. The dispensing system of claim 1, wherein said lid comprises one or more guiding means to guide the lid into proper placement with the base.

5. The dispensing system of claim 1, wherein said lid is a snap-on type lid.

6. The dispensing system of claim 1, wherein said lid is operatively connected to said base through at least one of the following: hinges, guide pins, panels, flanges, shafts, and bearings.

7. The dispensing system of claim 1, wherein the piercing fitment terminates at an angle to facilitate puncturing of said pouch fitment of the pouch.

8. The dispensing system of claim 1, wherein said piercing fitment operatively connects to and locks into said pouch fitment.

9. The dispensing system of claim 1, wherein said pouch is packaged in a corrugate, cardboard, or chipboard container prior to disposing the pouch within the bottom portion of said dispenser.

10. The dispensing system of claim 9, wherein said container comprises at least one hole in the top or bottom of said container to allow access to the pouch fitment.

11. The dispensing system of claim 1, wherein the pouch fitment is disposed on the inner or outer surface of the first wall of the pouch, about halfway between the first and second transverse seals of the pouch.

12. A method for dispensing a pumpable product from a pouch comprising:

(a) providing a dispenser comprising:

(i) a base having a plurality of upright wall and a bottom portion, said bottom portion comprising a support; and (ii) a lid for seating onto said base, said lid comprising a piercing fitment mounted to the inside of the lid; and (b) providing a pouch comprising:

i) a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal; and ii) a pouch fitment disposed on the first wall of the pouch, wherein the pouch is positioned in the base with the fitment-side facing up;

(c) filling said pouch with pumpable product;

(d) positioning said pouch inside said dispenser such that said pouch fitment is raised, centered, properly located, and supported by said support in the base;

(e.) positioning the lid onto the base such that the pouch fitment is pierced by the piercing fitment;

(f.) connecting a dispensing mechanism to the piercing fitment; and (g.) activating said dispensing mechanism to dispense the pumpable product from the pouch.

13. The method of claim 12, wherein said dispensing mechanism is selected from the group consisting of a: spigot, siphon, pump, tap, nozzle, hose, or combinations thereof.

14. The method of claim 12, wherein said lid comprises one or more guiding means to guide the lid into proper placement within the base.

15. The method of claim 12, wherein said lid is a snap-on type lid or is secured by friction or one or more closures.

16. The method of claim 12, wherein said lid is operatively connected to said base through at least one of the following: hinges, guide pins, panels, flanges, shafts, and bearings.

17. The method of claim 12, wherein the piercing fitment terminates at an angle to facilitate puncturing of said pouch fitment.

18. The method of claim 12, wherein said piercing fitment operatively connects to and locks into said pouch fitment.

19. The method of claim 12, wherein said pouch is packaged in a chipboard, cardboard, or corrugate container prior to disposing the pouch within the bottom portion of said dispenser.

20. The method of claim 19, wherein said container comprises at least one hole in the top or bottom of said container to allow access to the pouch fitment.

21. The method of claim 12, wherein the pouch fitment is disposed on the inner or outer surface of the first wall of the pouch, about halfway between the first and second transverse seals of the pouch.

22. A method of making a dispensing system, the method comprising:

(a) providing a dispenser comprising:

(i) a base having a plurality of upright walls and a bottom portion, said bottom portion comprising a support; and (ii) a lid for seating onto said base, said lid comprising a piercing fitment mounted to the inside of the lid; and (b) providing a pouch comprising:

i) a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal; and ii) a pouch fitment disposed on the first wall of the pouch, wherein the pouch is positioned in the base with the pouch fitment-side facing up;

(c) filling the pouch with a pumpable product;

(d) positioning the pouch inside said base of said dispenser such that said pouch fitment is raised, centered, and supported by said support in the base;

(e) connecting a dispensing mechanism to the piercing fitment; and (f) activating said dispensing mechanism to dispense the pumpable product from the pouch.

23. The method of claim 22, wherein said dispensing mechanism is selected from the group consisting of a: spigot, siphon, pump, tap, nozzle, or combinations thereof.

24. The method of claim 22, wherein said lid comprises one or more guiding means to guide the lid into proper placement with the base.

25. The method of claim 22, wherein said lid is a snap-on type lid.

26. The method of claim 22, wherein said lid is operatively connected to said base through at least one of the following: hinges, guide pins, panels, flanges, shafts, and bearings.

27. The method of claim 22, wherein the piercing fitment terminates at an angle to facilitate puncturing of said pouch fitment.

28. The method of claim 22, wherein said piercing fitment operatively connects to and locks into said pouch fitment.

29. The method of claim 22, wherein said pouch is packaged in a cardboard, chipboard, or corrugate container prior to disposing the pouch within the bottom portion of said dispenser.

30. The method of claim 29, wherein said container comprises at least one hole in the top or bottom of said container to allow access to the pouch fitment.

31. The method of claim 22, wherein the pouch fitment is disposed on the inner or outer surface of the first wall of the pouch, about halfway between the first and second transverse seals of the pouch.

* * * * *